US012691328B2

(12) United States Patent
Wang et al.

(10) Patent No.: US 12,691,328 B2
(45) Date of Patent: Jul. 28, 2026

(54) ELECTRIC STEPPER

(71) Applicant: Zhejiang Shimo technology Co.Ltd, Zhejiang City (CN)

(72) Inventors: Xiong Wang, Jinhua City (CN); Jiawu Zhang, Jinhua City (CN); Hua Wang, Jinhua City (CN)

(73) Assignee: Zhejiang Shimo technology Co.Ltd, Jinhua City (CN)

( * ) Notice: Subject to any disclaimer, the term of this patent is extended or adjusted under 35 U.S.C. 154(b) by 55 days.

(21) Appl. No.: 18/913,858

(22) Filed: Oct. 11, 2024

(65) Prior Publication Data

US 2025/0121251 A1 Apr. 17, 2025

(30) Foreign Application Priority Data

Oct. 11, 2023 (CN) ..... 202322738506.X

(51) Int. Cl.

| | |
|---|---|
| ***A63B 22/06*** | (2006.01) |
| ***A63B 21/00*** | (2006.01) |
| ***A63B 21/005*** | (2006.01) |
| ***A63B 24/00*** | (2006.01) |

(52) U.S. Cl.

CPC ..... *A63B 22/0694* (2013.01); *A63B 21/0058* (2013.01); *A63B 21/4034* (2015.10); *A63B 24/0087* (2013.01)

(58) Field of Classification Search

CPC . A63B 22/06; A63B 22/0605; A63B 22/0694; A63B 2022/0611; A63B 2022/0617

See application file for complete search history.

(56) References Cited

U.S. PATENT DOCUMENTS

| | | | | |
|---|---|---|---|---|
| 11,040,238 | B2 * | 6/2021 | Colburn | A63B 21/00069 |
| 11,452,908 | B1 * | 9/2022 | Eilers | A61B 5/702 |
| 12,251,599 | B2 * | 3/2025 | Colburn | A63B 22/0046 |
| 2019/0299053 | A1 * | 10/2019 | Friedman | A63B 21/0051 |
| 2020/0289889 | A1 * | 9/2020 | Hacking | A61H 1/00 |
| 2021/0113890 | A1 * | 4/2021 | Posnack | A63B 22/0694 |

* cited by examiner

*Primary Examiner* — Zachary T Moore

(57) ABSTRACT

An electric step, including a chassis, a housing, a motor, and two pedals. The housing is fixedly arranged on the chassis. A horizontal central shaft is fixedly arranged in the housing. Each of both ends of the central shaft is arranged with a turntable. An inner end of each pedal is arranged on a corresponding turntable. An axis of the pedal deviates from an axis of the central shaft. The motor is fixedly arranged in the housing and configured to drive the turntable to rotate via a transmission mechanism.

11 Claims, 4 Drawing Sheets

ELECTRIC STEPPER

CROSS REFERENCE TO RELATED APPLICATION

This application claims priority benefit of Chinese Patent Application No. 202322738506. X, filed on Oct. 11, 2023, and the entire contents of which are incorporated herein by reference.

TECHNICAL FIELD

The present disclosure relates to the technical field of fitness equipment, and specifically to an electric stepper.

BACKGROUND

A stepper is a piece of fitness equipment that allows exercisers to repeatedly climb stairs, thereby strengthening the cardiovascular system and fully exercising the thigh and calf muscles.

There are two main types of steppers: electric and ordinary. An ordinary stepper is adopted with a pneumatic piston instead of an engine to control the amplitude of the stepping motion. Compared with ordinary steppers, an electric stepper is adopted with a motor to control the amplitude of the stepping motion, thereby reducing the negative impact of stepping on the leg joints.

Chinese Patent No. CN206910672U discloses an electric stepper, in which the motor of the stepper is configured to drive the movement of the pedals through a crank-connecting rod transmission. This type of transmission method has the disadvantages of high processing costs and being easily damaged.

SUMMARY OF THE DISCLOSURE

The purpose of the present disclosure is to address the above-mentioned problems of existing electric steppers, and to propose an electric stepper that drives pedal movement through a turntable.

The purpose of the present disclosure can be achieved by the following technical solution.

An electric stepper, including: a chassis, a housing, a motor, and two pedals. The housing is fixedly arranged on the chassis. A horizontal central shaft is fixedly arranged in the housing. Each of both ends of the central shaft is arranged with a turntable. An inner end of each pedal is arranged on a corresponding turntable. An axis of the pedal deviates from an axis of the central shaft. The motor is fixedly arranged in the housing and configured to drive the turntable to rotate via a transmission mechanism.

In some embodiments, the transmission mechanism includes an output shaft fixedly connected to an output end of the motor, two driving wheels fixedly arranged on the output shaft, and two driven wheels rotatably arranged on the central shaft. One of the two driven wheels is arranged on one of the both ends of the central shaft, and the other of the two driven wheels is arranged on the other of the both ends of the central shaft. Each of the two driven wheels is fixedly connected to a corresponding turntable. A belt is wound and closed between each driving wheel and a corresponding driven wheel.

In some embodiments, a through hole is defined on each of opposite sides of the housing, and two the turntables are respectively rotatably arranged in two the through holes.

In some embodiments, the turntable is in an annular shape, and an edge of an inner hole of the turntable has an inner flange extending peripherally formed by bending towards the central shaft; the inner flange is arranged covering on an outer periphery of the central shaft; an outer edge of the turntable has an outer flange extending peripherally formed by bending towards the central shaft, which is embedded in a corresponding through hole.

In some embodiments, an inner diameter size of the inner flange is adapted to an outer diameter size of a corresponding outer end face of the central shaft; an outer diameter size of the outer flange is adapted to an inner diameter size of a corresponding through hole.

In some embodiments, a central hole extending along an axial direction is defined on the central shaft.

In some embodiments, a bushing is fixedly arranged on the outer end face of each turntable, and an inner end of a pedal shaft for a corresponding pedal is fixedly connected to the bushing. The pedal is rotatably arranged on the pedal shaft.

In some embodiments, each driven wheel is fixedly connected to the corresponding turntable via a connection seat.

In some embodiments, an outer wall of the central shaft defines a positioning groove extending peripherally on each of the both ends, and a corresponding driven wheel is rotatably arranged in the positioning groove.

In some embodiments, the housing is further arranged with a button configured to control start and stop of the motor.

The advantage of the present disclosure is that a turntable is arranged on each side of the housing, and by arranging a pedal on the turntable and driving the rotation of the turntable by a motor, the existing crank-connecting rod is abolished. The transmission method of the present disclosure is simple, has few parts, and has low processing costs.

Figure 1:
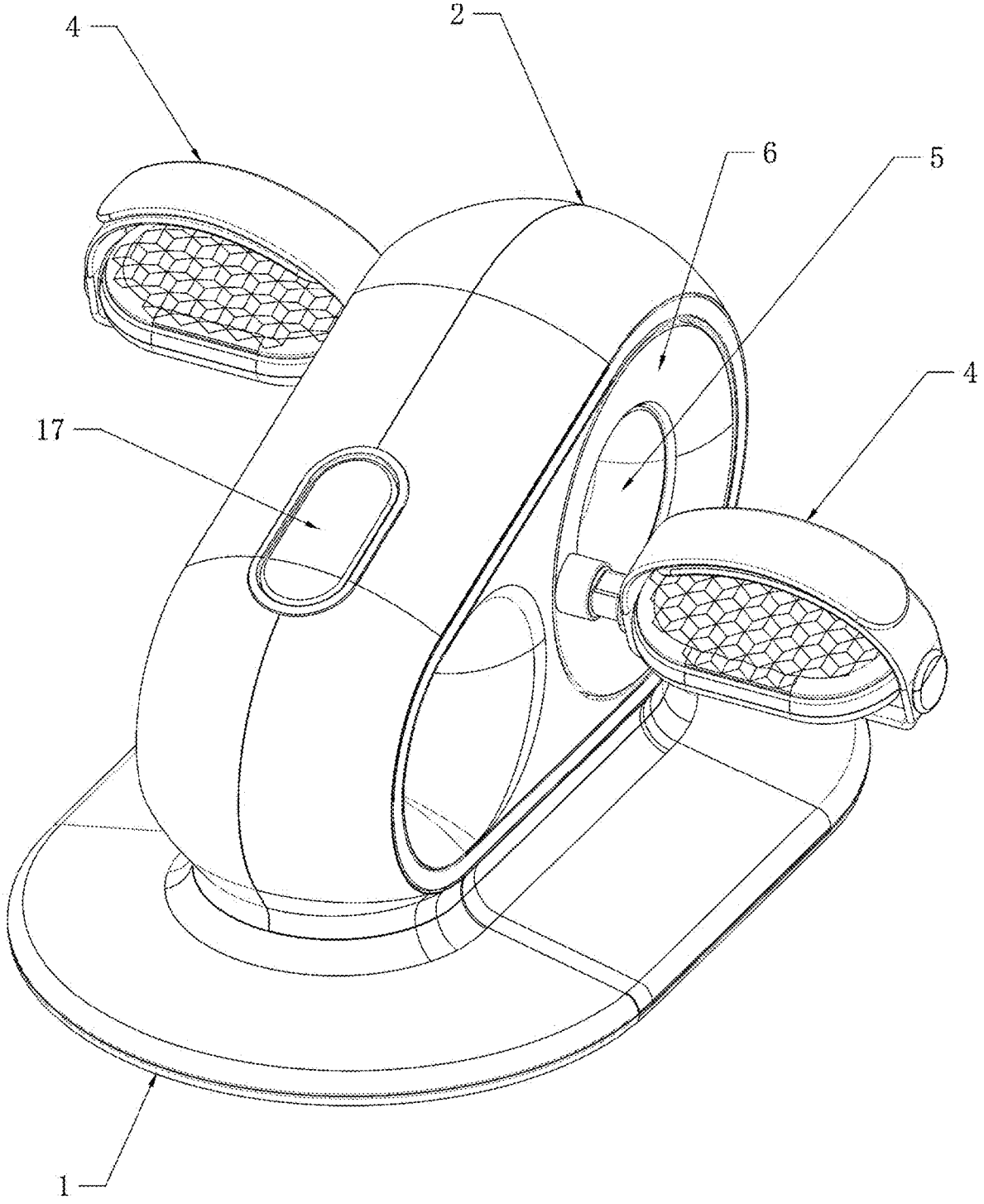
FIG. 1 is an entire structural schematic view of an electric stepper according to the present disclosure.

Reference numerals: 1, chassis; 2, housing; 3, motor; 4, pedal; 5, central shaft; 6, turntable; 7, output shaft; 8, driving wheel; 9, driven wheel; 10, belt; 11, inner flange; 12, outer flange; 13, central hole; 14, bushing; 15, connection seat; 16, positioning groove; 17, button.

DETAILED DESCRIPTION

The following are specific embodiments of the present disclosure, and the technical solution of the present disclosure is further described in combination with the accompanying drawings, but the present disclosure is not limited to these embodiments.

Figure 2:
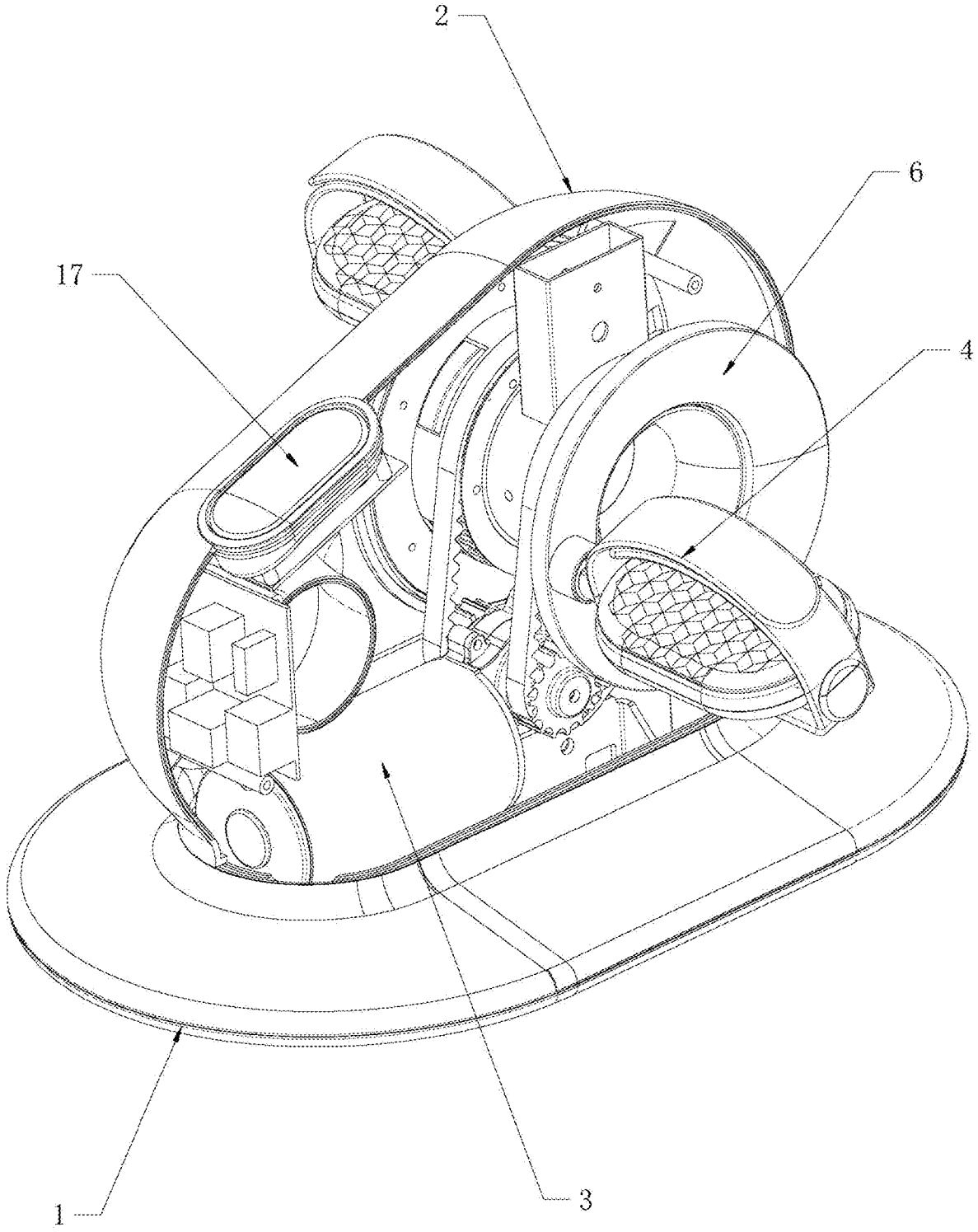
FIG. 2 is an inner structural schematic view of an electric stepper according to the present disclosure.

As shown in FIGS. 1 and 2, an electric stepper according to the present disclosure includes a chassis 1, a housing 2, a motor 3, and two pedals 4. The housing 2 is fixedly arranged on the chassis 1. A horizontal central shaft 5 is fixedly arranged in the housing 2. Each of both ends of the central shaft 5 is arranged with a turntable 6. An inner end of each pedal 4 is arranged on a corresponding turntable 6. An axis of the pedal 4 deviates from an axis of the central shaft 5. The motor 3 is fixedly arranged in the housing 2 and configured to drive the turntable 6 to rotate via a transmission mechanism. The housing 2 is further arranged with a button 17 configured to control the start and stop of the motor 3.

Figure 3:
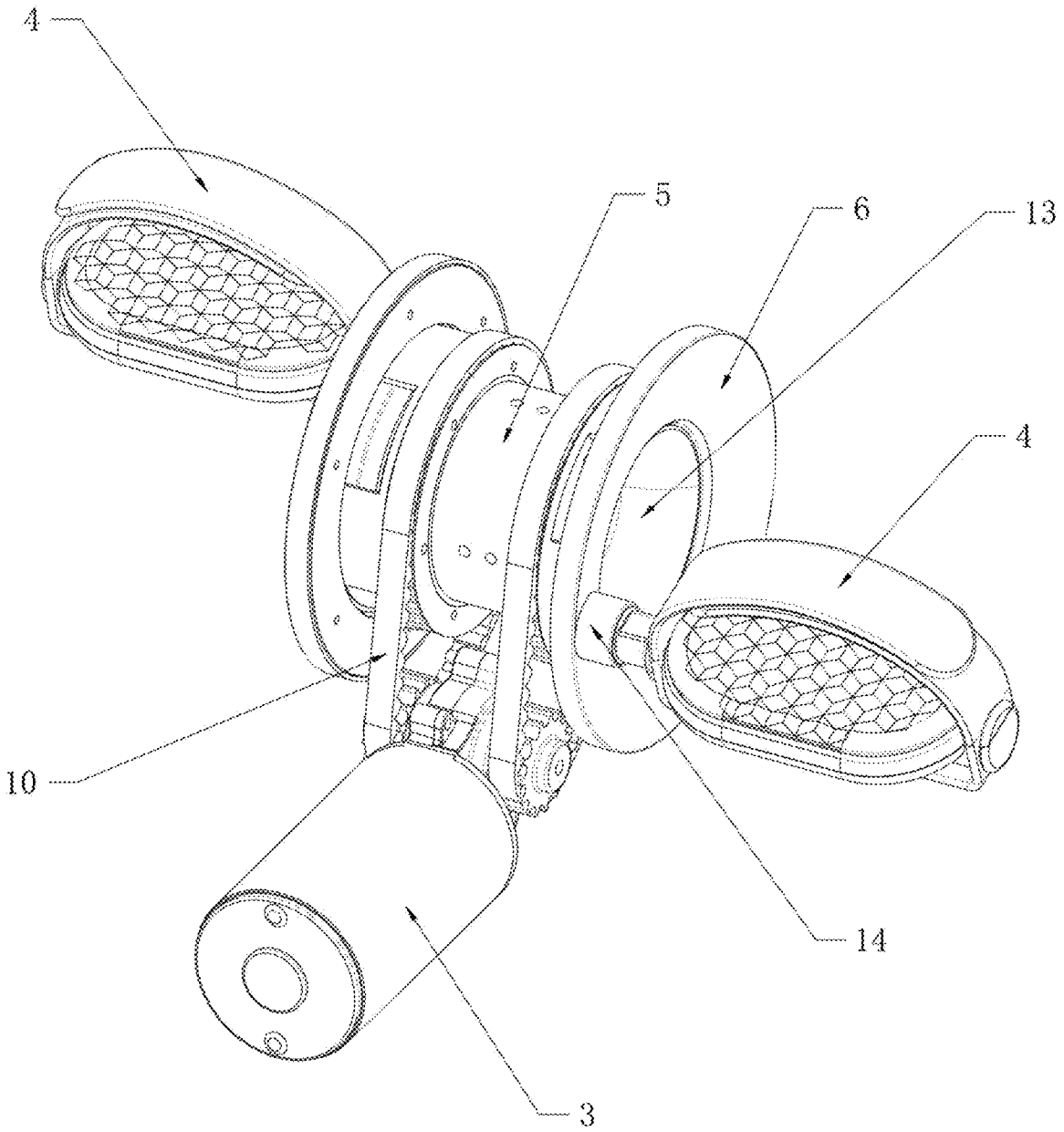
FIG. 3 is a structural view of a transmission mechanism, a central shaft, and a turntable according to the present disclosure.
Figure 4:
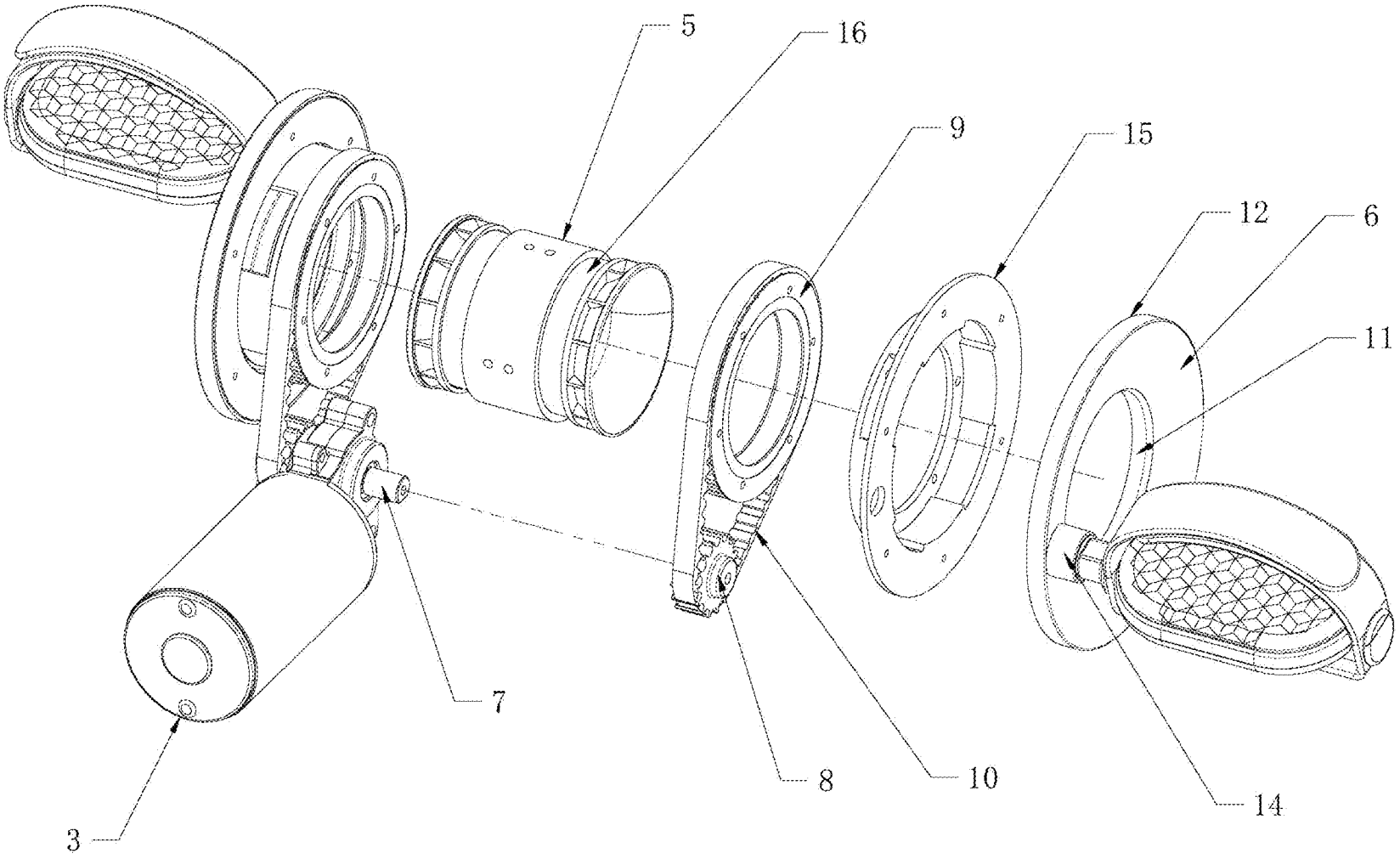
FIG. 4 is a schematic view of the installation of a transmission mechanism, a central shaft, and a turntable according to the present disclosure.

As shown in FIGS. 3 and 4, the transmission mechanism includes an output shaft 7 fixedly connected to an output end of the motor 3, two driving wheels 8 fixedly arranged on the output shaft 7, and two driven wheels 9 rotatably arranged on the central shaft 5. One of the two driven wheels 9 is arranged on one of the both ends of the central shaft 5, and the other of the two driven wheels 9 is arranged on the other of the both ends of the central shaft 5. Each of the two driven wheels 9 is fixedly connected to a corresponding turntable 6. A belt 10 is wound and closed between each driving wheel 8 and a corresponding driven wheel 9. Each driven wheel 9 is fixedly connected to the corresponding turntable 6 via a connection seat 15. An outer wall of the central shaft 5 defines a positioning groove 16 extending peripherally on each of the both ends, and a corresponding driven wheel 9 is rotatably arranged in the positioning groove 16.

A through hole is defined on each of the left and right sides of the housing 2, and the two turntables 6 are respectively rotatably arranged in the corresponding through holes. An outer end face of each turntable 6 is flush with an outer end face of the housing 2. A central hole 13 extending along an axial direction is defined on the central shaft 5. A bushing 14 is fixedly arranged on the outer end face of each turntable 6, and an inner end of a pedal shaft for a corresponding pedal 4 is fixedly connected to the bushing 14. The pedal 4 is rotatably arranged on the pedal shaft.

The turntable 6 is in the shape of a ring, and an edge of an inner hole of the turntable 6 has an inner flange 11 extending peripherally formed by bending towards the central shaft 5. The inner flange 11 is arranged covering on an outer periphery of the central shaft 5. An outer edge of the turntable 6 has an outer flange 12 extending peripherally formed by bending towards the central shaft 5, which is embedded in a corresponding through hole. An inner diameter size of the inner flange 11 is adapted to an outer diameter size of a corresponding outer end face of the central shaft 5; an outer diameter size of the outer flange 12 is adapted to an inner diameter size of the corresponding through hole.

It should be understood that in the claims and description of the present disclosure, all the terms of "including" should be understood to have an open meaning. That is, the terms are equivalent to "containing at least . . . ", and should not be understood to have a closed meaning, i.e., they should not be understood to mean "containing only . . . ".

The specific embodiments described herein are merely examples that illustrate the spirit of the present disclosure. Those skilled in the art may make various modifications or additions to the specific embodiments described or replace them with similar means, without departing from the spirit of the present disclosure or exceeding the scope defined by the appended claims.

What is claimed is:

1. An electric stepper, comprising:

a chassis;

a housing, fixedly arranged on the chassis; wherein a central shaft is horizontally and fixedly arranged in the housing, and each of both ends of the central shaft is arranged with a turntable;

two pedals; wherein each pedal is fixedly arranged on a corresponding turntable; an axis of each pedal deviates from an axis of the central shaft; and a motor, fixedly arranged in the housing and configured to drive the turntable to rotate via a transmission mechanism;

wherein the transmission mechanism comprises an output shaft fixedly connected to an output end of the motor; two driving wheels fixedly arranged on the output shaft, and two driven wheels rotatably arranged on the central shaft; one of the two driven wheels is arranged on one of the both ends of the central shaft, and the other of the two driven wheels is arranged on the other of the both ends of the central shaft; each of the two driven wheels is fixedly connected to a corresponding turntable; each of the two driving wheels is connected to a corresponding driven wheel in a transmission manner through a belt;

wherein a through hole is defined on each of opposite sides of the housing, and two the turntables are respectively rotatably arranged in two the through holes;

wherein the turntable is in an annular shape, and an edge of an inner hole of the turntable has an inner flange extending peripherally formed by bending towards the central shaft; the inner flange is arranged covering on an outer periphery of the central shaft; an outer edge of the turntable has an outer flange extending peripherally formed by bending towards the central shaft, which is embedded in a corresponding through hole.

2. The electric stepper according to claim 1, wherein an inner diameter size of the inner flange is adapted to an outer diameter size of a corresponding outer end face of the central shaft.

3. The electric stepper according to claim 2, wherein an outer diameter size of the outer flange is adapted to an inner diameter size of a corresponding through hole.

4. The electric stepper according to claim 1, wherein a central hole extending along an axial direction is defined on the central shaft.

5. The electric stepper according to claim 1, wherein each driven wheel is fixedly connected to the corresponding turntable via a connection seat.

6. The electric stepper according to claim 1, wherein an outer wall of the central shaft defines a positioning groove extending peripherally on each of the both ends, and a corresponding driven wheel is rotatably arranged in the positioning groove.

7. The electric stepper according to claim 1, wherein the housing is further arranged with a button configured to control start and stop of the motor.

8. An electric stepper, comprising:

a chassis;

a housing, fixedly arranged on the chassis; wherein a central shaft is horizontally and fixedly arranged in the housing, and each of both ends of the central shaft is arranged with a turntable;

two pedals; wherein each pedal is fixedly arranged on a corresponding turntable; an axis of each pedal deviates from an axis of the central shaft; and a motor, fixedly arranged in the housing and configured to drive the turntable to rotate via a transmission mechanism;

wherein the transmission mechanism comprises an output shaft fixedly connected to an output end of the motor; two driving wheels fixedly arranged on the output shaft, and two driven wheels rotatably arranged on the central shaft; one of the two driven wheels is arranged on one of the both ends of the central shaft, and the other of the two driven wheels is arranged on the other of the both ends of the central shaft; each of the two driven wheels is fixedly connected to a corresponding turntable; each of the two driving wheels is connected to a corresponding driven wheel in a transmission manner through a belt;

wherein an outer wall of the central shaft defines a positioning groove extending peripherally on each of the both ends, and a corresponding driven wheel is rotatably arranged in the positioning groove.

9. The electric stepper according to claim 8, wherein a central hole extending along an axial direction is defined on the central shaft.

10. The electric stepper according to claim 8, wherein each driven wheel is fixedly connected to the corresponding turntable via a connection seat.

11. The electric stepper according to claim 8, wherein the housing is further arranged with a button configured to control start and stop of the motor.

* * * * *